US012661574B1

(12) United States Patent
Nevarez

(10) Patent No.: US 12,661,574 B1
(45) Date of Patent: Jun. 23, 2026

(54) BILLIARDS CUE BALL STROKE TRAINING AID

(71) Applicant: Michael Nevarez, Phoenix, AZ (US)

(72) Inventor: Michael Nevarez, Phoenix, AZ (US)

( * ) Notice: Subject to any disclaimer, the term of this patent is extended or adjusted under 35 U.S.C. 154(b) by 435 days.

(21) Appl. No.: 18/132,705

(22) Filed: Apr. 10, 2023

Related U.S. Application Data

(60) Provisional application No. 63/329,144, filed on Apr. 8, 2022.

(51) Int. Cl.
*A63D 15/00* (2006.01)

(52) U.S. Cl.
CPC ..... *A63D 15/006* (2013.01)

(58) Field of Classification Search
CPC ..... A63D 15/006
USPC ..... 473/2
See application file for complete search history.

(56) References Cited

U.S. PATENT DOCUMENTS 3,711,091 A * 1/1973 Dixon ..... A63D 15/006 434/247
3,759,513 A 9/1973 Gillett
3,947,026 A * 3/1976 Scoutten ..... A63D 15/006 473/2
D312,290 S 11/1990 Rodriguez
5,322,475 A 6/1994 Irvin
D391,614 S 3/1998 Meredith
D453,364 S 2/2002 Brothers
6,343,995 B1 * 2/2002 Green, Jr. ..... A63D 15/105 473/43
6,527,647 B2 * 3/2003 Ringeisen ..... A63B 69/00 33/506
7,303,483 B2 * 12/2007 Black ..... A63D 15/006 473/2
10,729,941 B2 8/2020 Park et al.
D959,556 S 8/2022 Travis, II
2005/0064946 A1 3/2005 Cianflone
2007/0219005 A1 9/2007 Jones
2012/0149481 A1 6/2012 Christiansen

FOREIGN PATENT DOCUMENTS

CN 103768783 A 5/2014

* cited by examiner

*Primary Examiner* — Mitra Aryanpour
(74) *Attorney, Agent, or Firm* — Bycer & Marion, PLC; Matthew L. Bycer

(57) ABSTRACT

A billiard ball used as a training aid for billiards. The ball may include a cored through hole or a hollow or removed section sized to allow the head of a cue stick to be set therethrough. The holes may be set though the center, and may include a widened bevel side to allow for entry from various angles. The ball may include a flat surface offset by ninety-degrees from both apertures, and/or may be useful with a flat set piece. A dowel may be set in the through hole.

14 Claims, 6 Drawing Sheets

BILLIARDS CUE BALL STROKE TRAINING AID

CLAIM OF PRIORITY

The present application includes subject matter disclosed in and claims priority to a provisional application entitled "Billiards Cue Ball Stroke Training Aid" filed Apr. 8, 2022 and assigned Ser. No. 63/329,144, describing an invention made by the present inventor, herein incorporated by reference.

BACKGROUND OF THE INVENTION

1. Field of the Invention

The present invention relates to billiards ball used as a training aid.

2. Description of Related Prior Art

Billiards are leisure sports played on a billiards table to score points by hitting red and white balls using a cue stick. Billiards are generally categorized as four-ball billiards, carom billiards, pool, and the like. Four-ball billiards is played using two red balls and two white balls, while carom billiards is played using a single red ball and two white balls.

Pool is played by a wide number of people. Most individuals enjoy playing pool because it is generally a simple sport to start playing by merely striking a cue stick to a cue ball. The challenge comes when people want to play well. Pool is a challenging sport to excel at because of all the technical aspects involved. The player must concentrate on the speed of their stroke, the balance of their cue stick on their support hand, the angle of stroke, the strike location on the cue ball and the trajectory of the cue ball on the pool table. With a lot of training and practice individuals are able to be talented and master the fine sport.

Some people use training tools and instructors to help them learn to play well. The training tools may help with balance and angles to help the person strike the cue ball. Alternatively, the instructors are useful because they are able to provide feedback and suggestions to the player to that they can immediately correct and practice their form.

According to the terms used in billiards, a ball hit with a cue stick by a player is referred to as a "cue ball," a first ball contacted by the cue ball is referred to as a "first object ball," and a second ball contacted by the cue ball is referred to as a "second object ball."

When playing a billiard game or practicing billiards, a cue ball is hit with a cue stick to contact a predetermined point on a first object ball. Here, it is necessary to aim the tip of the cue stick at a specific point. However, the point, to which the tip of the cue stick is to be directed, may be obscured and is unfixed, and thus, it may be difficult for a novice to aim.

That is, although billiard experts advise novices to perform the aiming on the basis of conceptual and numerical bases, it is impossible to determine a point of the object ball on which the tip of the cue stick is to be aimed. When delivering a cue ball to an object ball, it is essentially important to accurately aim the cue ball to hit an intended point on the object ball in order to improve billiard skills. Regardless of such necessity, no related-art solutions, by which aiming at an intended point on the object ball can be trained, have been found

SUMMARY OF THE INVENTION

The present invention is directed to a billiard ball training aid such as a standard cue ball or numbered ball, as is known in the art, often in the shape of a sphere or spheroid. The sphere or spheroid may include a channel bored through, and preferably is sized to allow at least the diameter of a cue stick tip therethrough. A flattened portion of the ball may be buffed out, flattened, or otherwise set on the surface of the ball. The flattened bottom may be set along a plane defined by the bottom and the channel openings. The portion may be used to stabilize position/orientation of the ball against the flooring surface or table surface. A flattened sheet or plate may be used, the sheet may include an aperture. The sheet may include marking with direction of impact, and 90-degree offsets for the tangential line.

A dowel may be placed in the channel. When a numbered ball 9-15 is used, the channel is placed ninety-degrees of the marking. The channel may include asymmetric channel openings, preferably with a beveled side with a flare to allow for action approaches from various angles that are not entirely perpendicular the channel and ball center.

A method for training is also disclosed. A sphere or spheroid ball may be placed on a flat surface in a particular secured orientation, with a channel set through the sphere or spheroid ball, running a cue stick through the channel. A dowel may be placed in the channel that may be optionally tapped, slightly moved, or pushed through during practice. The sheet may be placed under the ball, or in front of the ball for marking expected impact.

BRIEF DESCRIPTION OF THE DRAWINGS

The present invention will be described with greater specificity and clarity with reference to the following drawings, in which.

DETAILED DESCRIPTION OF THE PREFERRED EMBODIMENTS

A core channel is drilled or otherwise eliminated through the center of the ball. The core should be at least, if not wider that the diameter of a tip of a cue stick as is known in the art. The channel is preferably expanded at one end, with the opening made wider to allow for easier entry of the incoming cue stick end. The ball is preferably made from phenolic resin. The size of channel is preferably ¾ inch to ⅝ inch. The channel may be 19 mm to 13 mm+.

A dowel 20 piece is preferably set inside and flush with the ball channel or slightly smaller in diameter. The idea is that a player uses the cue stick to softly push the dowel in the hole to build and train strength of stroke. The dowel may include gradations n inches and meters (as a ruler) to allow one to measure the distance pushed through the channel on soft stroke. The channel is preferably set perpendicular marking ball number. Otherwise, a cue ball (all white) is preferred).

The ball is preferably seated on a washer, either plastic, metal or paper. A thin film plastic is preferred. Otherwise, the ball may include a polished flatted end (as shown in the 6-ball, preferably through the number. Alternative flat points may be situated along the plane between the bottom and both openings. These flat areas may be 45-degree, or more preferably 10 degrees, 20-degrees, and thirty degrees to allow for trick and angled down/up shots. A film placement as is known the art may be placed under the ball, where the is no flat portion to help stabilize ball angle. A 1 mm acrylic film pad is preferred to minimize change in height of ball. A second washer or disc may be used to raise the height of the ball to compensate for the flattened portion.

A billiard ball used as a training aid for billiards. The ball may include a cored through hole or a hollow or removed section sized to allow the head of a cue stick to be set therethrough. The holes may be set though the center, and may include a widened bevel side to allow for entry from various angles. The ball may include a flat surface offset by ninety-degrees from both apertures, and/or may be useful with a flat set piece. A dowel may be set in the through hole.

Figure 1:
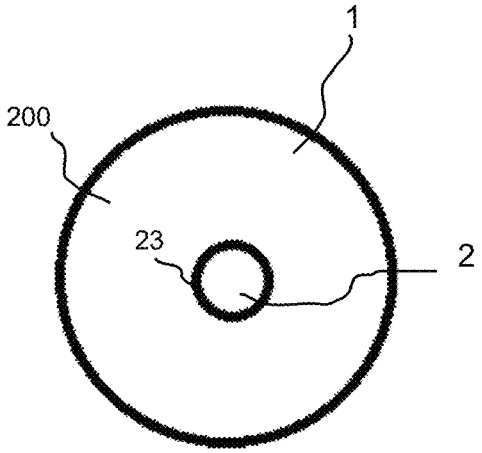
FIG. 1 illustrates a rear side of a training ball of an embodiment of the present invention.
Figure 2:
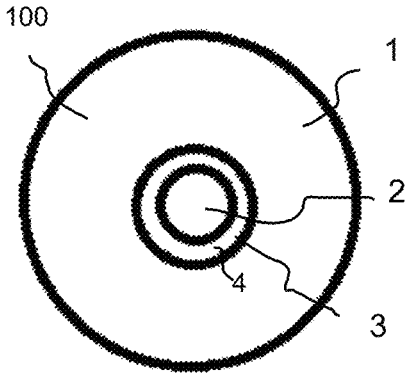
FIG. 2 illustrates a front side of a training ball of an embodiment of the present invention.
Figure 3:
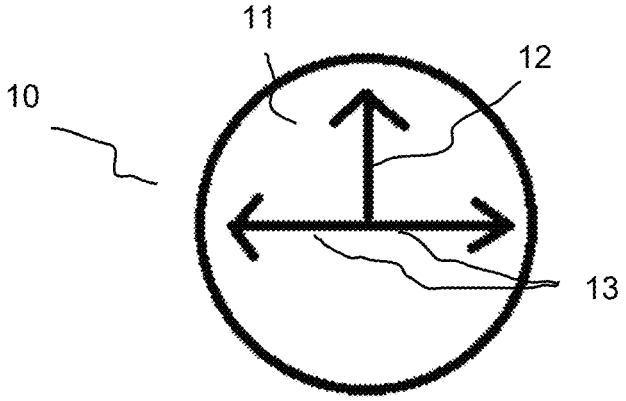
FIG. 3 illustrates a top view of a marked placer mat of an embodiment of the present invention.

As seen in the Figures, FIG. 1 shows rear side of ball 1 with through hole 2 and rear edge 23 of hole 2. FIG. 2. shows front side of ball 1 with through hole 2 and beveled entry flare 4 with bevel edge 3. FIG. 3 shows the placement mat 10 with direction lines 11, including the pocket directive 12, and the tangential lines 13 with arrows showing where the cue may ricochet.

Figure 4:
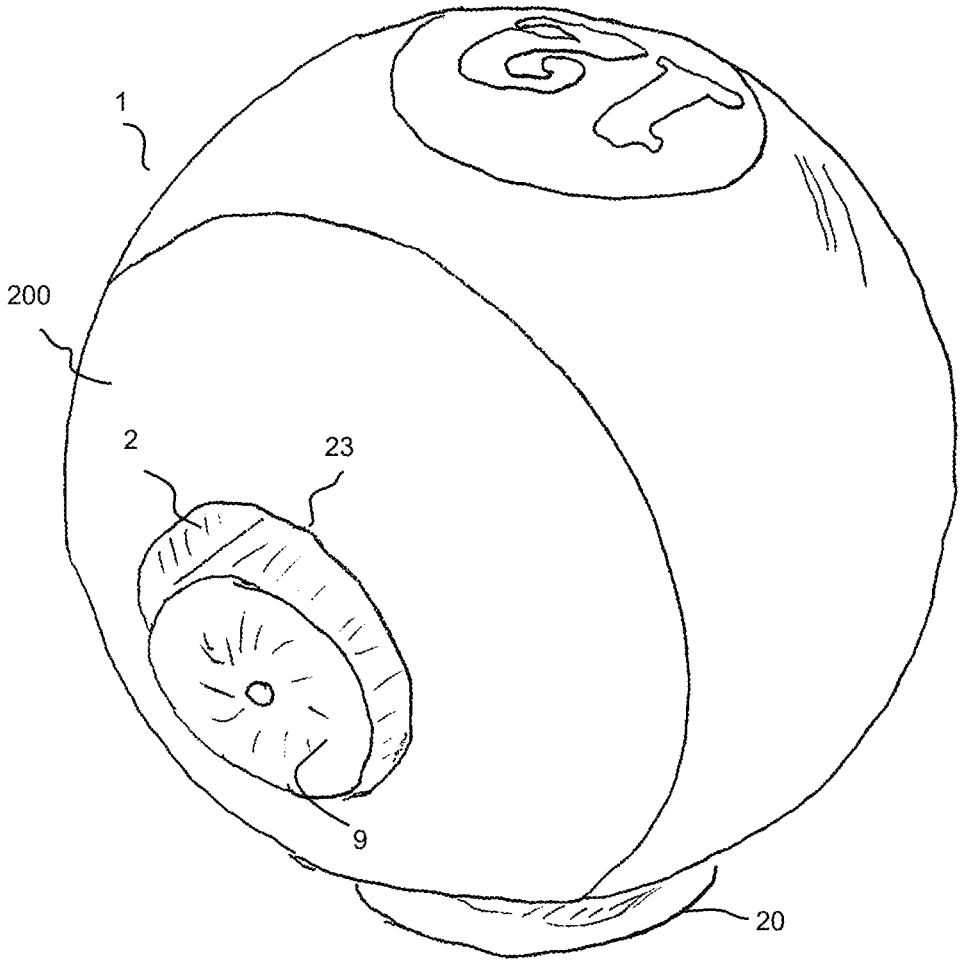
FIG. 4 illustrates a top rear perspective view of a training ball with dowel of an embodiment of the present invention.
Figure 5:
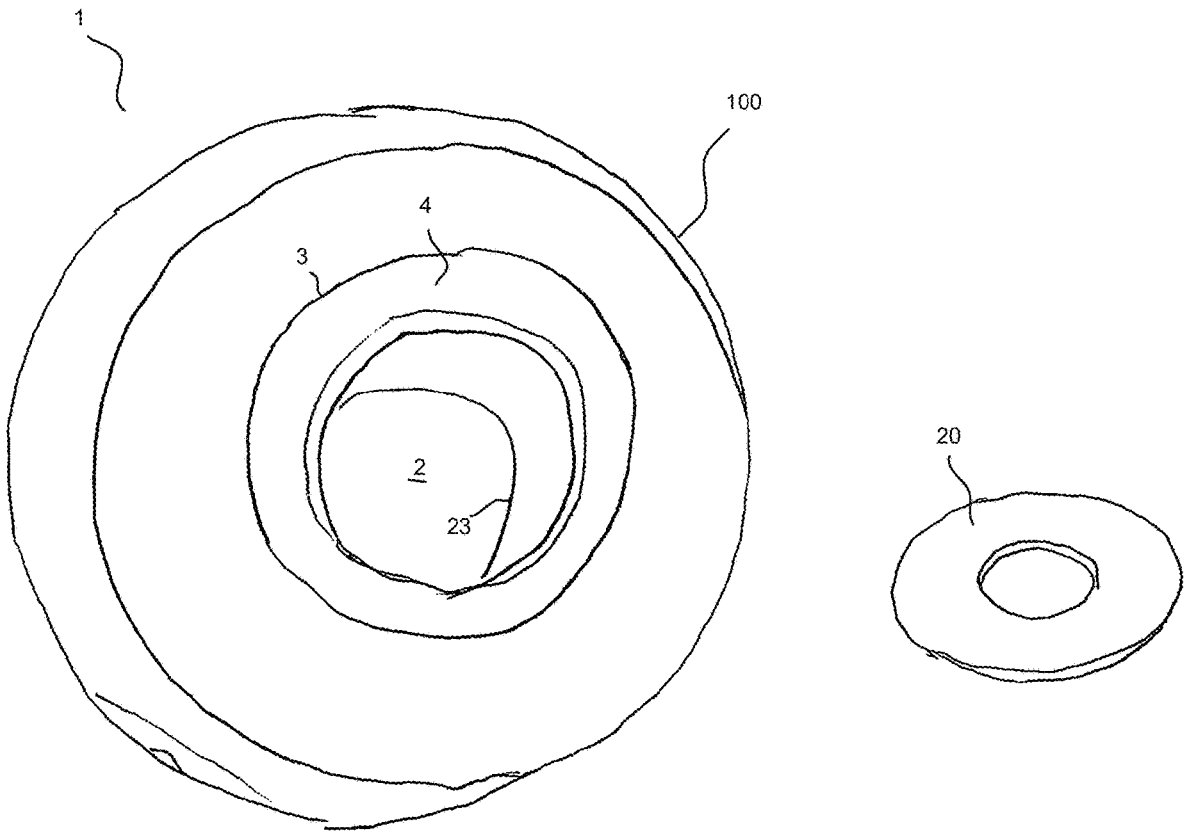
FIG. 5 illustrates a front perspective view of a training ball separated from donut of an embodiment of the present invention.

As seen in FIGS. 4-5, FIG. 4 illustrates ball 1 from rear side 200 showing hole 2 and hole rear edge 23. Dowel 9 is dset through hole 2. Ball 1 sits on donut 20. FIG. 5 illustrates fron side 100 of ball 1 with hole 2. Rear edge 23 is seen through hole 2, while bevel 4 and bevel ede 3 are shown in front. Donut 20 is set aside ready for ball placement thereon.

Figure 6:
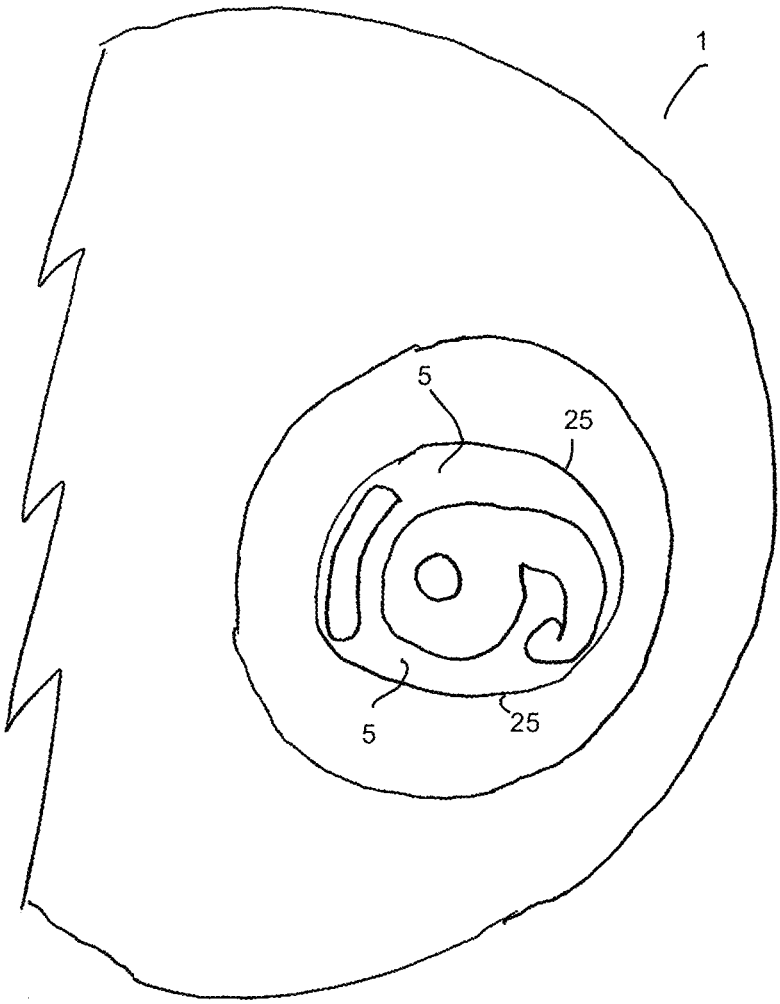
FIG. 6 illustrates a partial side view of a training ball of an embodiment of the present invention.
Figure 7:
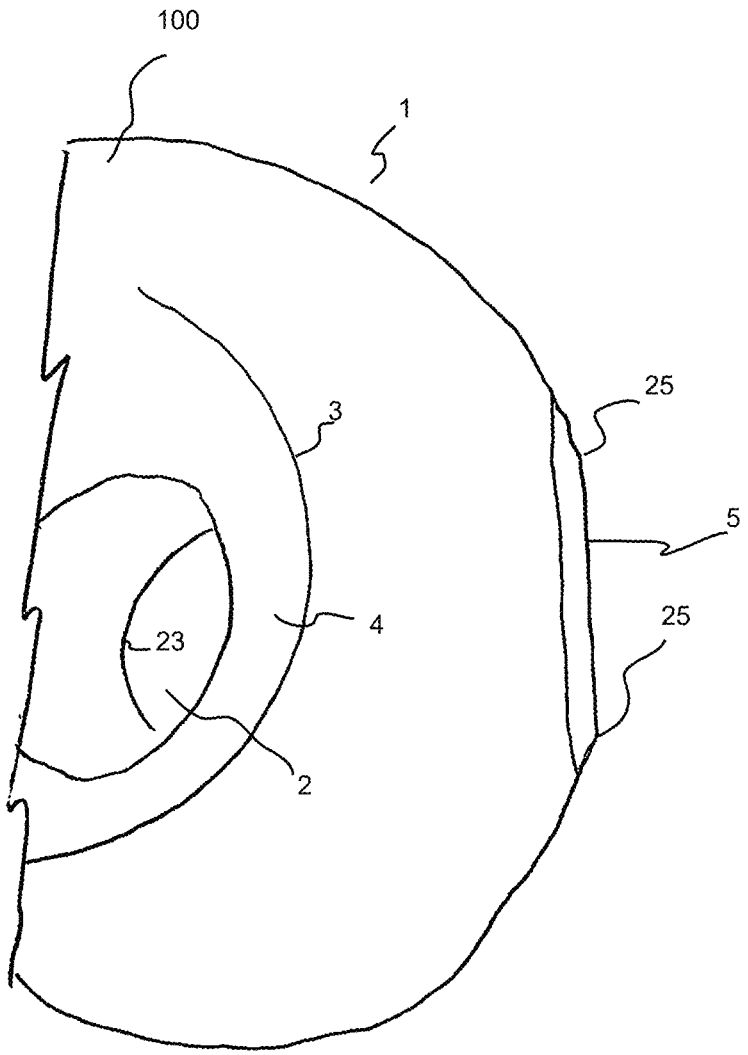
FIG. 7 illustrates a partial front view of a training ball of an embodiment of the present invention.

As seen in FIGS. 6-7, FIG. 6 shows a side view of ball 1, with flattened face 5 defined by circular flatted face edge 25. When viewed from the front, as in FIG. 7, ball 1 with front side 100 includes hole 2, bevel 4 with bevel edge 3. Shown in side profile is the flattened face 5 with edges of flattened face 25.

I claim:

1. A billiard ball training aid comprising a sphere or spheroid, the sphere or spheroid having a channel bored through with at least the diameter of a cue stick tip, and further comprising means for stabilizing a position or orientation of the ball against a support surface;

wherein a cylindrical dowel is placed within the channel.

2. The billiard ball of claim 1 wherein the means for stabilizing comprises a donut.

3. The billiard ball of claim 1 wherein the billiard ball training aid comprises a number marking and said channel is perpendicular relative to the number marking.

4. The billiard ball of claim 1 wherein the sphere or spheroid includes asymmetric channel openings.

5. The billiard ball of claim 1 wherein the sphere or spheroid includes a flattened bottom.

6. The billiard ball of claim 1 wherein the means for stabilizing comprises a flattened surface.

7. The billiard ball of claim 1 wherein the channel comprises a first end having a beveled entry surface.

8. The billiard ball of claim 7 wherein the channel comprises a second end opposite the first end.

9. The billiard ball of claim 1 wherein the means for stabilizing comprises a mat.

10. The billiard ball of claim 9 wherein said mat is a circular disc.

11. The billiard ball of claim 6 wherein the flattened surface comprises a circular face.

12. A method for billiard stroke training, including the steps of placing a sphere or spheroid ball on a flat surface;

wherein said step of placing the sphere or spheroid ball on a flat surface includes placing the sphere or spheroid ball onto a flattened face of the sphere or spheroid ball, or placing the sphere or spheroid ball onto a disc;

boring a channel through the sphere or spheroid, and wherein, said channel includes two openings on either end;

placing a cylindrical dowel within said channel; and running a cue stick through said channel by softly pushing the dowel in the hole to build and strengthen a user's billiard stroke.

13. The method of claim 12 whereby said step of placing comprises placing the sphere or spheroid ball on a flat surface includes placing the sphere or spheroid ball onto a donut.

14. The method of claim 12 whereby said step of placing the sphere or spheroid ball on a flat surface includes placing the channel with a first opening in a first direction, and a second beveled opening opposite the first direction.

* * * * *